United States Patent [19]

Cole

[11] Patent Number: 4,742,654

[45] Date of Patent: May 10, 1988

[54] PROTECTIVE BARRIER FOR A STRUCTURAL BEAM

[76] Inventor: John D. Cole, P.O. Box 610, Scottsburg, Oreg. 97473

[21] Appl. No.: 27,947

[22] Filed: Mar. 19, 1987

[51] Int. Cl.[4] ..... E04D 13/00; E04B 1/64; E04B 1/66

[52] U.S. Cl. ..... 52/97; 52/58; 52/101; 52/105; 52/173 R; 52/263; 52/410; 428/63

[58] Field of Search ..... 52/105, 395, 403, 97, 52/173 R, 169.9, 301, 410, 58, 62, 263, 101; 428/63, 77, 78

[56] References Cited

U.S. PATENT DOCUMENTS

| | | | |
|---|---|---|---|
| 494,848 | 4/1893 | Durkin | 52/101 |
| 1,843,948 | 2/1932 | Friedrich . | |
| 2,139,225 | 12/1938 | Easling | 52/101 X |
| 2,140,407 | 12/1938 | Schilling . | |
| 2,165,500 | 7/1939 | Muirhead . | |
| 2,242,266 | 5/1941 | Scales . | |
| 2,859,486 | 11/1958 | Rovich | 52/410 X |
| 3,439,950 | 4/1969 | Kunevicius | 428/77 X |
| 3,777,438 | 12/1973 | Brown | 52/173 R |
| 3,808,762 | 5/1974 | Hurst | 52/403 |
| 3,810,707 | 5/1974 | Tungseth et al. | 52/395 X |
| 4,502,259 | 3/1985 | Smith | 52/403 X |

*Primary Examiner*—Alfred C. Perham
*Attorney, Agent, or Firm*—James D. Givnan, Jr.

[57] ABSTRACT

A protective cap of inverted channel shape for placement on beams to protect same from moisture. A lengthwise extending recess in the cap upper surface receives a pliable sealant having a surface which is in pressurized contact with a beam supported structural member. A seal is thus provided about fasteners driven through the cap. Diverging side walls of the cap discharge moisture away from the beam sides.

5 Claims, 1 Drawing Sheet

PROTECTIVE BARRIER FOR A STRUCTURAL BEAM

BACKGROUND OF THE INVENTION

The present invention resides within that class of articles relating to protective means for installation along a structural beam member of a building.

Wooden structural members are subject to degradation from moisture as well as organisms which, over a period of time, necessitates replacement of the beam. Such is particularly true of beams exposed to the weather such as joists in wooden decking. The treatment of wooden decks and the like with preservatives does little to protect the sub-structure of the decking, usually spaced apart beams or joists. Further, the penetration of the sub-decking members by fasteners adds to deterioration by reason of the fastener providing a path for the entry of moisture into the beam interior. Not uncommon, in certain environments, is periodic replacement every few years of beams and other structural members exposed to the weather. When such beams are part of a wooden deck considerable manhours are required to accomplish such beam replacement.

The chemical treating of wooden beam members is not effective to prevent entry of moisture along a beam penetrating fastener.

Summary of the Present Invention

The present invention is embodied within a protective cap for placement lengthwise along a structural member with a sealant preventing entry of moisture along a beam penetrating fastener.

The present cap is of elongate configuration formed in the general configuration of an inverted channel. The uppermost surface of the cap is adapted to receive a sealant which overlies a central portion of the cap to effectively seal the sites of fastener penetration. The sealant is of a consistency as to be deformed by a superimposed structural member assuring intimate contact between the sealant and the beam engaging fastener. Preferably the top surface of the cap defines a central recessed area in which continuous sealant resides to provide a relatively wide sealant band to receive fasteners inserted in an imprecise manner. Side walls of the protective cap diverge outwardly and downwardly relative the upright sides of the beam to deflect water away from the beam sides. An acute edge on each side wall inhibits water droplet size.

Important objectives of the present protective means for a beam include the provision of a channel-like structure having a sealant disposed therealong to effect a moisture tight seal with any fastener driven into the beam; the provision of protective means for a beam wherein said means is of generally like construction in section having a recessed area in which a sealant is inset; the provision of protective means for a beam which lends itself to low cost, high volume protective methods rendering a low manufacturing cost and a price attractive to the purchaser.

DETAILED DESCRIPTION OF THE PREFERRED EMBODIMENTS

Figure 1:
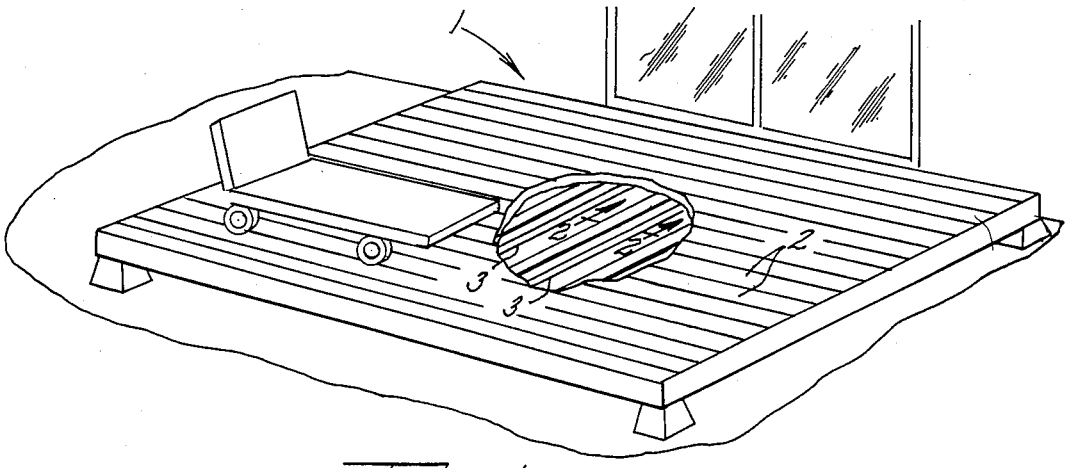
FIG. 1 a perspective view of exterior decking with the present barrier in place thereon.

With continuing attention to the drawings wherein applied reference numerals indicate parts similarly hereinafter identified, the reference numeral 1 indicates an exterior wooden structure shown as a home attached deck having wooden decking members at 2 overlying joists at 3.

Figure 2:
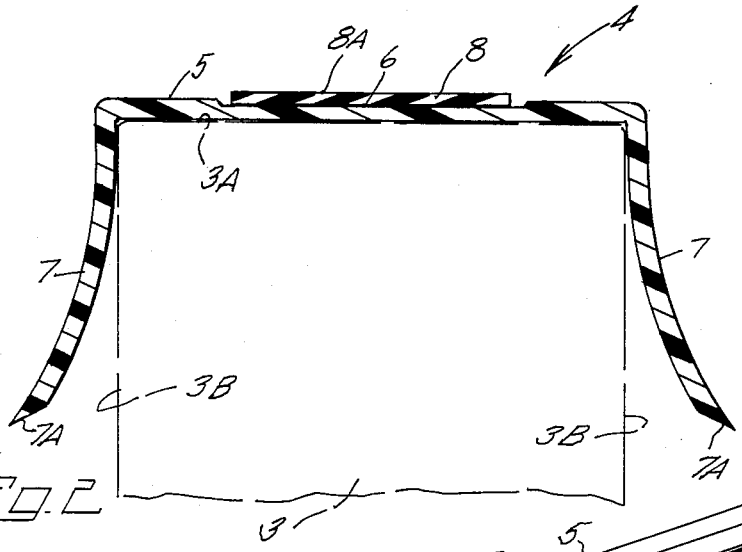
FIG. 2 is a vertical sectional view taken along line 2—2 of FIG. 1.
Figure 3:
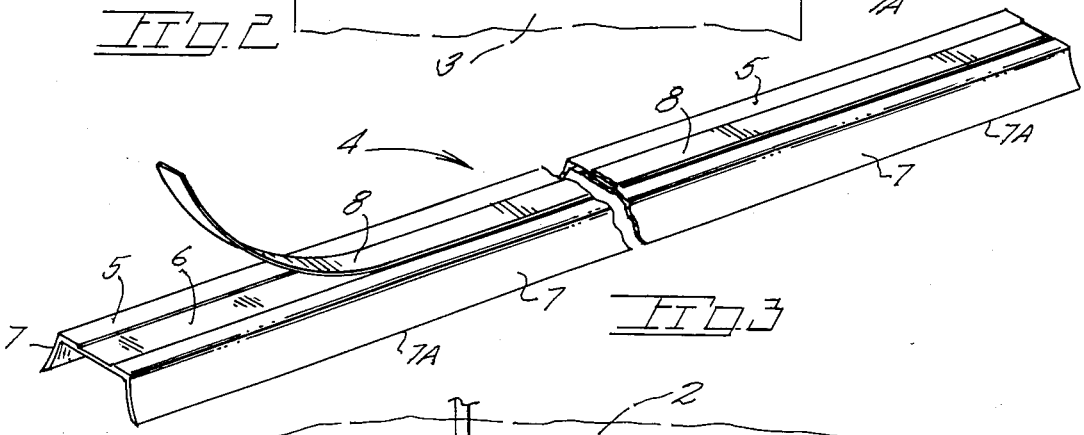
FIG. 3 is a perspective view of the protected barrier removed from adjacent structure and sectioned for convenience of illustration.

The present protective means, indicated generally at 4 in FIG. 2, is adapted to overlie the uppermost surface of 3A of each joist between the joist and the decking 2.

A top wall 5 of the protective means defines a recessed area 6 which extends lengthwise therealong. Side walls at 7 are integral with the lateral extremities of top wall 5 and diverge outwardly and downwardly away from the sides 3B of the joists. Preferably the side walls 7 terminate downwardly in acute edges 7A to inhibit the formation of large water droplets. The joist sides are accordingly protected from moisture.

The present protective means is of generally inverted channel section and dimensioned to closely engage the uppermost surface 3A of the joist with side walls 7 located adjacent the joist sides 3B. While shown as in surface contact with sides 3B of the joist, it will be understood that in view of dimensional irregularities of finished lumber, clearance between joist sides 3B and side walls 7 is acceptable.

Recessed area 6, extending along the length of the protective means, is of a depth to receive a sealant 8 coextensive with top wall 5. While the type of sealant may vary for certain uses, one suitable sealant is butyl tape. Preferably the tape thickness exceeds the depth of recessed area 6 so as to provide an upper tape surface 8A which is offset somewhat above a horizontal plane containing top wall 5. Such an offset assures pressurizing contact with the decking 2 or other overlying member with the sealant and the subjection of the sealant to loading or compression to assure a seal about a fastener F. The sealant, as above noted, may be in the form of tape applied to top wall 5 of the protective means or a ribbon of material applied to the recessed area during formation of the top wall and side walls such as by extrusion.

Figure 4:
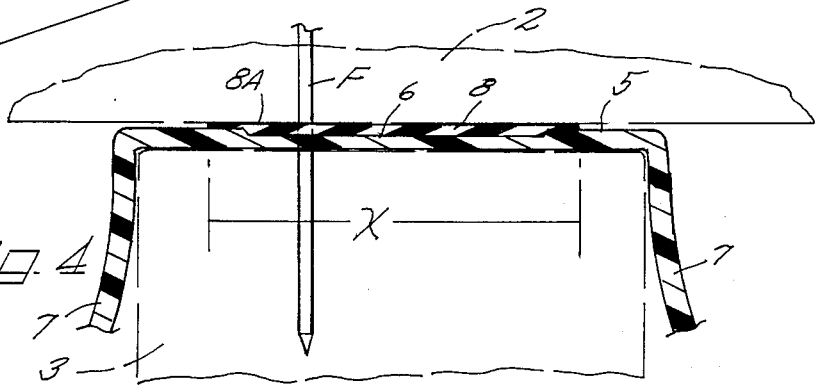
FIG. 4 is a view similar to FIG. 2 but showing a superimposed structural member in place on the barrier and secured by a fastener.

As shown in FIG. 4, the effective width of the sealant is indicated at X to provide an area of substantial width extending transversely across top wall 5 to receive fastener F regardless of the fastener being driven into the joist somewhat off center. While the transverse distance X constitutes a major portion of the joist width, it is entirely within the scope of the present invention that the sealant could be of greater or lesser transverse dimension than that indicated at X.

The elongate, inverted channel body 4 may be of a synthetic resinous material which lends itself to extrusion and which provides a surface to which the butyl tape or other sealant adheres.

While I have shown but one embodiment of the invention, it will be apparent to those skilled in the art that the invention may be embodied still otherwise without departing from the spirit and scope of the invention.

Having thus described the invention, what is claimed and desired to be secured in a Letters Patent is:

1. Protective means for installation between superimposed structural members of a building structure the lowermost of said structural members being a beam having a top wall and sides perpendicular thereto, said means comprising, an elongate body for placement along the upper surface of the beam and having a horizontal top wall and upright side walls for depending disposition adjacent the beam sides, said top wall defining a recessed area, a sealant in place along said elongate body within said recessed area and capable of forming a seal about a beam engaging fastener inserted therethrough, said sealant having an upper surface offset above a horizontal plane containing said horizontal top wall of the elongate body, said sealant being displaceable transversely of said top wall during use, and said elongate body and sealant constituting a barrier to protect the beam from moisture and other beam degrading entities.

2. The protective means claimed in claim 1 wherein said elongate body is of inverted channel configuration with said side walls diverging downwardly and outwardly from one another.

3. The protective means claimed in claim 2 wherein said side walls terminate downwardly in acute edges.

4. The protective means claimed in claim 1 wherein said sealant is continuous.

5. The protective means claimed in claim 4 wherein said sealant is of a transverse width so as to overlie a major portion of said top wall.

* * * * *